US007316239B2

(12) United States Patent
Yang

(10) Patent No.: US 7,316,239 B2
(45) Date of Patent: Jan. 8, 2008

(54) SUNSHADE TENT

(76) Inventor: Lien-Chuan Yang, 11F-1, No. 149, Sec. 3, Roosevelt Rd., Taipei (TW)

( * ) Notice: Subject to any disclaimer, the term of this patent is extended or adjusted under 35 U.S.C. 154(b) by 0 days.

(21) Appl. No.: 11/246,182

(22) Filed: Oct. 11, 2005

(65) Prior Publication Data

US 2007/0079859 A1 Apr. 12, 2007

(51) Int. Cl.
*E04H 15/40* (2006.01)

(52) U.S. Cl. ..... 135/137; 135/117

(58) Field of Classification Search ..... 135/137, 135/116, 114, 115, 117, 120.3, 119, 120.4
See application file for complete search history.

(56) References Cited

U.S. PATENT DOCUMENTS

| | | | | | |
|---|---|---|---|---|---|
| 2,167,219 | A * | 7/1939 | Sankey | 135/133 |
| 4,106,520 | A * | 8/1978 | Warner et al. | 135/133 |
| 4,719,934 | A * | 1/1988 | Mydans | 135/90 |
| 4,739,784 | A * | 4/1988 | Fast | 135/117 |
| 5,215,109 | A * | 6/1993 | Kent, Jr. | 135/137 |
| 5,404,896 | A * | 4/1995 | Howe | 135/125 |
| D378,118 | S * | 2/1997 | Lah | D21/838 |
| 5,628,336 | A * | 5/1997 | Lee | 135/114 |
| 6,138,700 | A * | 10/2000 | Stoddart | 135/87 |
| 7,004,183 | B2 * | 2/2006 | Gillis | 135/124 |
| 2003/0178055 | A1 * | 9/2003 | Laakso et al. | 135/119 |

* cited by examiner

*Primary Examiner*—David Dunn
*Assistant Examiner*—Noah Chandler Hawk
(74) *Attorney, Agent, or Firm*—Lowe Hauptman Ham & Berner, LLP

(57) ABSTRACT

A sunshade tent, having a ground cloth, a sunshade cloth and a supporting part, the side corner of the ground cloth is provided with at least one first adapting module and second adapting module, each of the adapting module is fixed on the ground with a ground nail, respectively; the sunshade cloth is combined at its two sides separately with one flexible part, wherein two ends of two flexible parts is connected with the first adapting modules disposed diagonally. Two end of the supporting part are connected separately with the second adapting modules disposed diagonally, such that the supporting part is intersected with the two flexible parts. By fixing the sunshade cloth on the the supporting part with a fastener, the sunshade cloth can slide relative to the supporting part, thereby the sunshade cloth can be fixed securely at place on the supporting apart and can shelter sunlight illuminating from various angles.

10 Claims, 6 Drawing Sheets

SUNSHADE TENT

BACKGROUND OF THE INVENTION

1. Field of the Invention

The invention relates to a sunshade tent, and more particular, to an outdoor sunshade tent characterized in that it is composed of sunshade cloths interconnected with one another and a supporting structure in a configuration that these sunshade cloths can be connected firmly with a ground cloth fixed on the ground, and these sunshade cloths can be adjusted to change shading direction in accordance with the sun light illuminating angle.

2. Description of the Prior Art

For one who loves sunlight, it is an enjoyment to receive a warm sunlight outdoor (especially, on a sand beach). Unfortunately, since the living environment on the earth has been damaged artificially and depletion of the ozone atmosphere had been occurred, hence the level of ultraviolet ray in the sunlight is increased such that a long time exposure under sunlight will cause rather the risk of incidence of skin disease than enjoyment.

Referring to FIG. 7, a conventional sunshade umbrella a comprises a supporting rack c for arranging a sunshade cloth b, and a supporting pole d for supporting the whole supporting rack c and the sunshade cloth b. When the spread area of the sunshade cloth b is increased, the supporting rack c and supporting pole d will bear higher load. In order to attain an effective supporting, the volume and the weight of the sunshade umbrella a would be invariably increased, which not only causes the inconvenience during transporting and storage, but also consumes space. Further, the sunshade cloth b described above can shelter only light illuminated downwardly from above, and as the sun shifts to yield different illuminating angle, the sunshade effect of the sunshade umbrella a might decrease greatly.

In view of the foregoing, in order to overcome the above-mentioned disadvantages, such that a sunshade tent can be carried conveniently, space saving and the direction of its sunshade cloth can be adjusted in accordance with the incident angle of sunlight, the inventor had research and developed constantly and intensively for many years based on his abundant experience, and finally, accomplished the invention.

SUMMARY OF THE INVENTION

The main objective of the invention is to provide a sunshade tent characterized in that, by virtue of a combination structure composed of a ground cloth that can be dismantled and reassembled, a sunshade cloth and a supporting part, it can be carried conveniently in favor of transporting and space saving for storage.

Another objective of the invention is to provide a sunshade tent characterized in that, by means of overlapping sunshade cloths and a supporting part structure, the sunshade cloth can be fixed on place firmly.

Yet another objective of the invention is to provide a sunshade tent characterized in that, by means of a sunshade cloth that can slide over a supporting part, the direction of the sunshade cloth can be adjusted in accordance with the incident angle of the sunlight so as to shelter the sunlight.

In order to achieve the above-described objectives, there is provided by the invention a sunshade tent that comprises a ground cloth, a sunshade cloth and a supporting part, wherein said ground cloth is provided at its corners with at least one set of a first adapting module and a second adapting module, each of these adapting modules is fixed into the ground with a ground nail. Said sunshade cloth is combined with a flexible part on its each side, wherein two sides of each flexible part is connected with the first adapting module disposed diagonally. Two sides of said supporting part are connected with the second adapting module disposed diagonally in a manner that the supporting part is intersected with those two flexible parts so as to fix sunshade cloth at position.

At the central position of the above-described sunshade cloth, an accommodating space is provided to allow the supporting part penetrating through such that the sunshade cloth can slide relative to the supporting part. Further, by fixing sunshade cloth on the supporting part with a fastener, sunlight incident from various angles can be sheltered.

BRIEF DESCRIPTION OF THE DRAWINGS

These features and advantages of the present invention will be fully understood and appreciated from the following detailed description of the accompanying Drawings.

DETAILED DESCRIPTION OF THE PREFERRED EMBODIMENT

For deeper understanding of the invention, a detailed description in conjunction with accompanying drawings is provided below.

Figure 1:
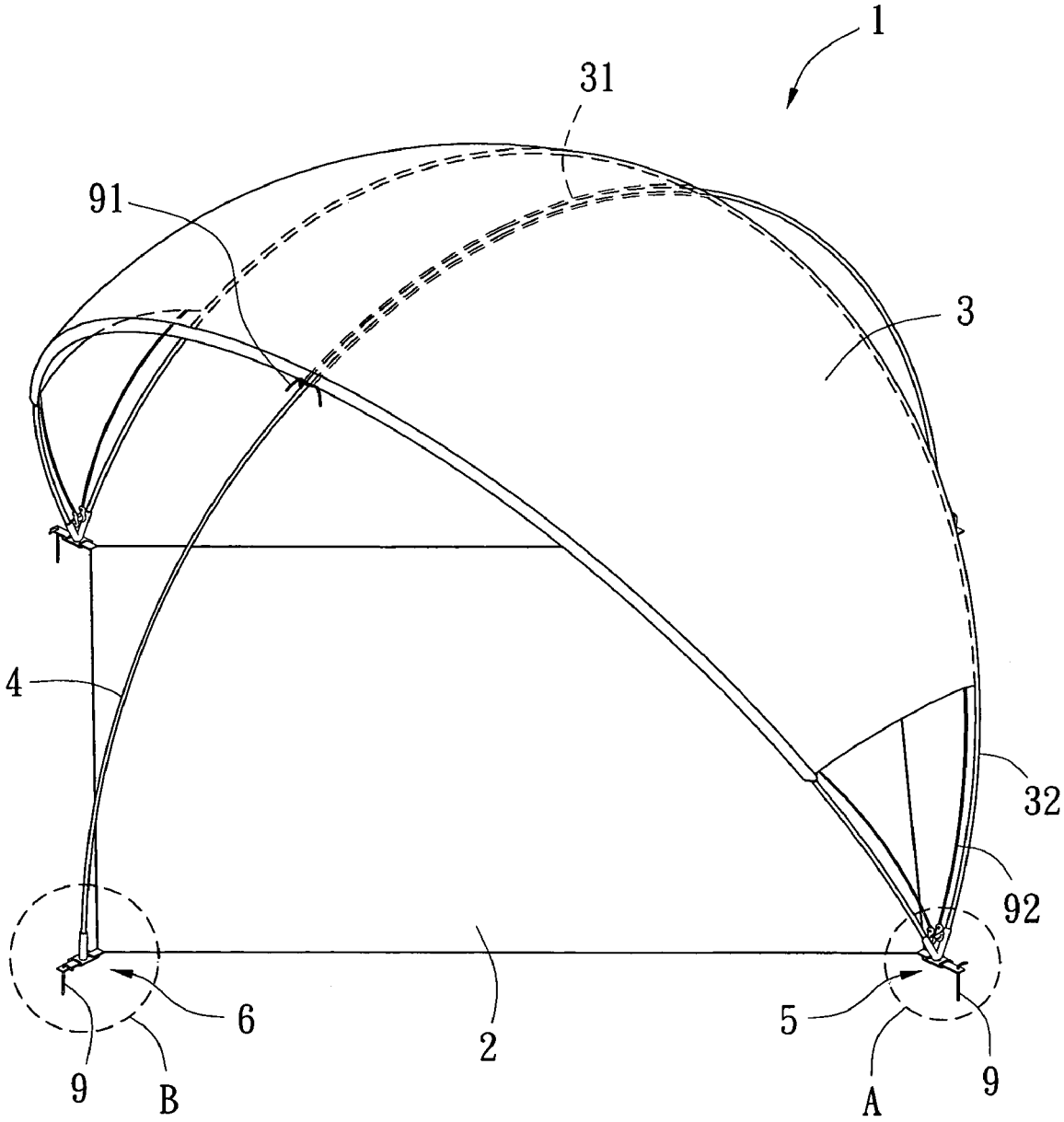
FIG. 1 is a three-dimensional external view of the sunshade tent according to a first embodiment of the invention.
Figure 2:
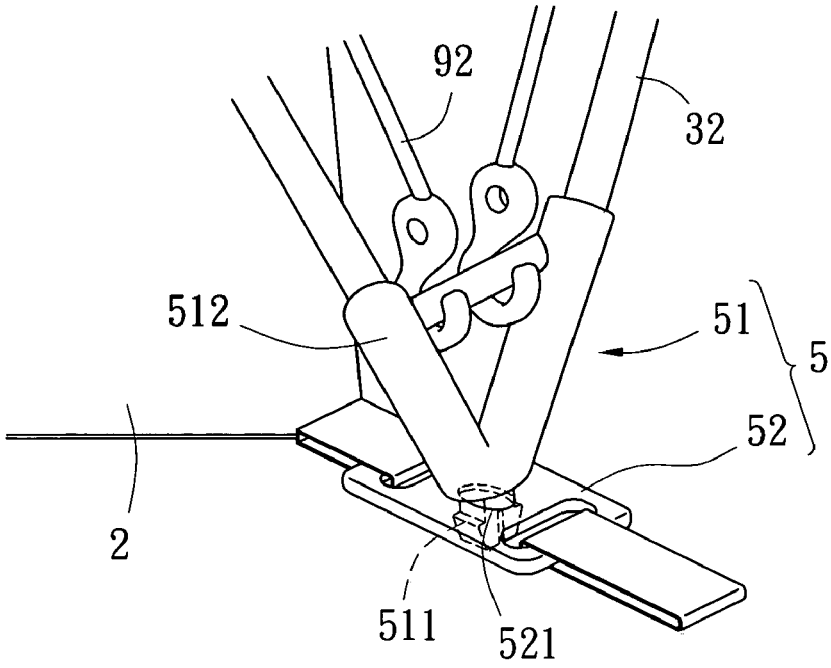
FIG. 2 is a partial enlarged view of the portion A in FIG. 1.
Figure 3:
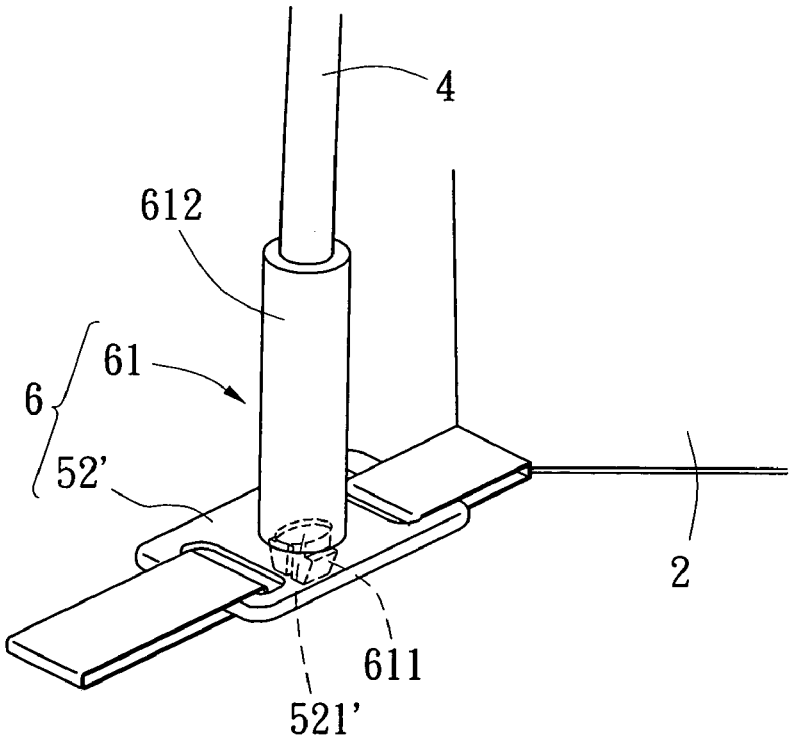
FIG. 3 is a partial enlarged view of the portion B in FIG. 1.

Referring to FIGS. 1-3, a sunshade tent 1 according to the first embodiment of the invention comprises a ground cloth 2, a sunshade cloth 3 and a supporting part 4, wherein said supporting part 4 is a flexible long pole.

Said ground cloth 2 is in a square form, a first adapting module 5 and a second adapting module 6 are provided at two sets of its diagonal ends, respectively. Said first adapting module 5 comprises a first adaptor 51 and a connecting part 52 for tying the side corner of the ground cloth 2. Said first adaptor 51 is provided at its lower end with an elastic fastener 511, while said connecting part 52 is provided with an elliptic through hole 521 running from the upper side through the lower side, which allows the elastic fastener 511 to penetrate therethrough and engage the first adaptor 51 and the connecting part 52. Further, the upper side of said first adaptor 51 is in a form of inverted A, and its two ends are in a shape of circular tube to act as a receiving part 512.

Said second adapting module 6 comprises a second adaptor 61 and a connecting part 52' for tying the side corner of the ground cloth 2. Said second adaptor 61 is provided at its lower end with an engaging part 611 that, after penetrating through an elliptic through hole 521' provided in said connecting part 52', can engage the second adaptor 61 and the connecting part 52'. Further, the upper side of said second adaptor 61 is provide at its upper end with a bearing part 612 in a form of circular tube.

Said sunshade cloth 3 is generally in an elongated strip form with a wide central portion and narrow front and rear ends. Said sunshade cloth 3 is provided at its central portion with an accommodating space 31 which may be a hollow pocket, composed of a plurality of rings, and the like. The left and right sides of said sunshade cloth 3 is combined with flexible parts 32 in the form of two long poles, respectively.

During the assembly of the sunshade tent 1, according to the invention the adapting modules 5 and 6 at the four corners of the ground cloth 2 are fixed on the ground with ground nails 9, respectively. One end of the support part 4 is positioned on both sides of the ground cloth 2 and is inserted into two receiving parts 512 on the upper sides of the first adaptor 51, respectively while the other end of support part 4 is inserted into two receiving parts 512 on the upper sides of the other first adaptor 51, respectively, thereby the central portion of said sunshade cloth 3 can be spread outwardly and bent upwardly into an arched form.

After the supporting part 4 penetrates the accommodating space 31 at the central portion of the sunshade cloth 3, the supporting 4 is intersected with those two flexible part 32, wherein two ends of the supporting part 4 is inserted into a bearing part 612 at the upper ends of those two second adaptor 61 provided at diagonal corners of the ground cloth 2, respectively, so as to fix the supporting part 4 and render the supporting part 4 to bend upwardly. By tying the flexible part 32 and the supporting part 4 with a tying rope, the sunshade cloth 3 can be fixed on the supporting part 4, where, the tying rope is used as a fastening part 91.

By virtue of the above combination, the sunshade cloth 3 can be spread outwardly, and connected firmly on the ground cloth 2, while, as the front and rear ends of the sunshade cloth 3 are combined with those two fasteners 92, and one ends of those two fasteners 92 are engaged with those two first adaptors 5 at the diagonal corner of the ground cloth 2, the sunshade cloth 3 can be stretched tightly so as to render the sunshade cloth 3 to be in a tightly stretched state.

Figure 4:
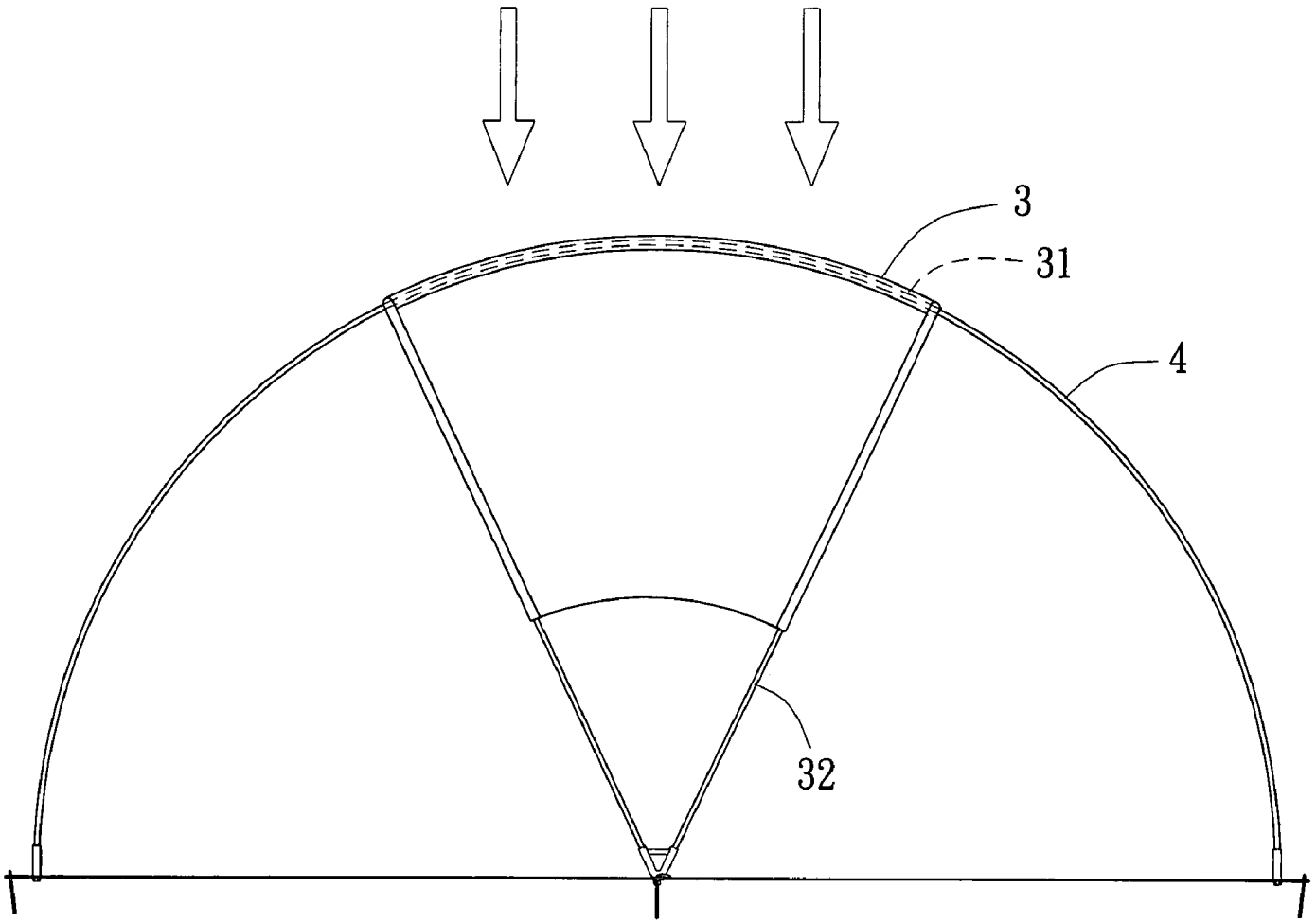
FIG. 4 is a view showing the state in use of the sunshade tent according to the first embodiment of the invention.
Figure 5:
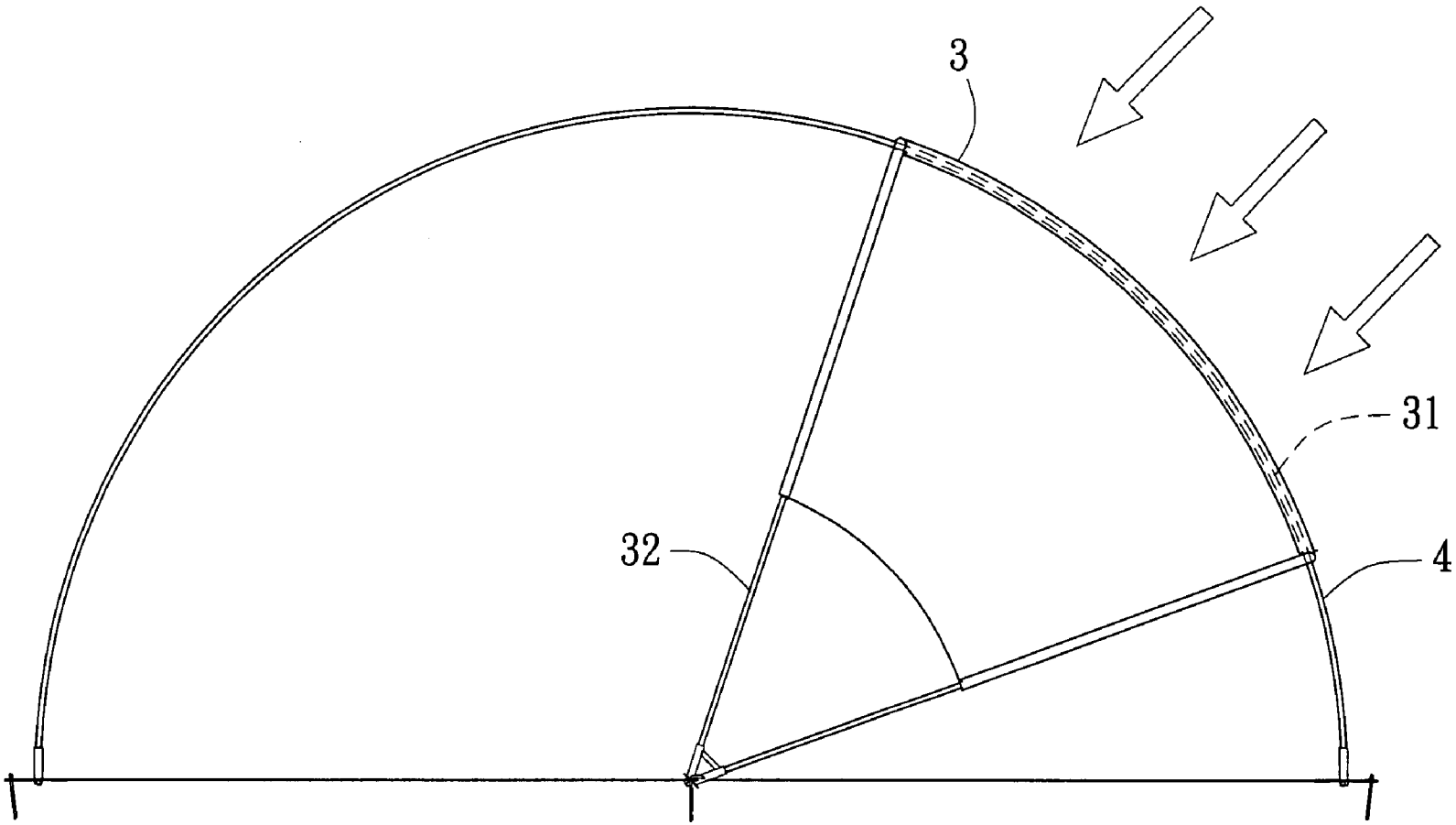
FIG. 5 is a view showing another state in use of the sunshade tent according to the first embodiment of the invention.

Referring to FIG. 4 and 5, a state in use of the sunshade tent according to the invention is shown, wherein, after the sunshade cloth 3 and those two flexible parts 32 are fixed on the central portion of the supporting part 4, the sunlight incident from the right upside can be sheltered. On the other hand, as the supporting part 4 moves in the accommodating space 31 at the central portion of the sunshade cloth 3, the sunshade cloth 3 and those two flexible parts 32 can slide relatively on the supporting part 4 so as to adjust the sunshade cloth 3 to various angles and shelter selectively sunlight illuminating from different angles.

Figure 6:
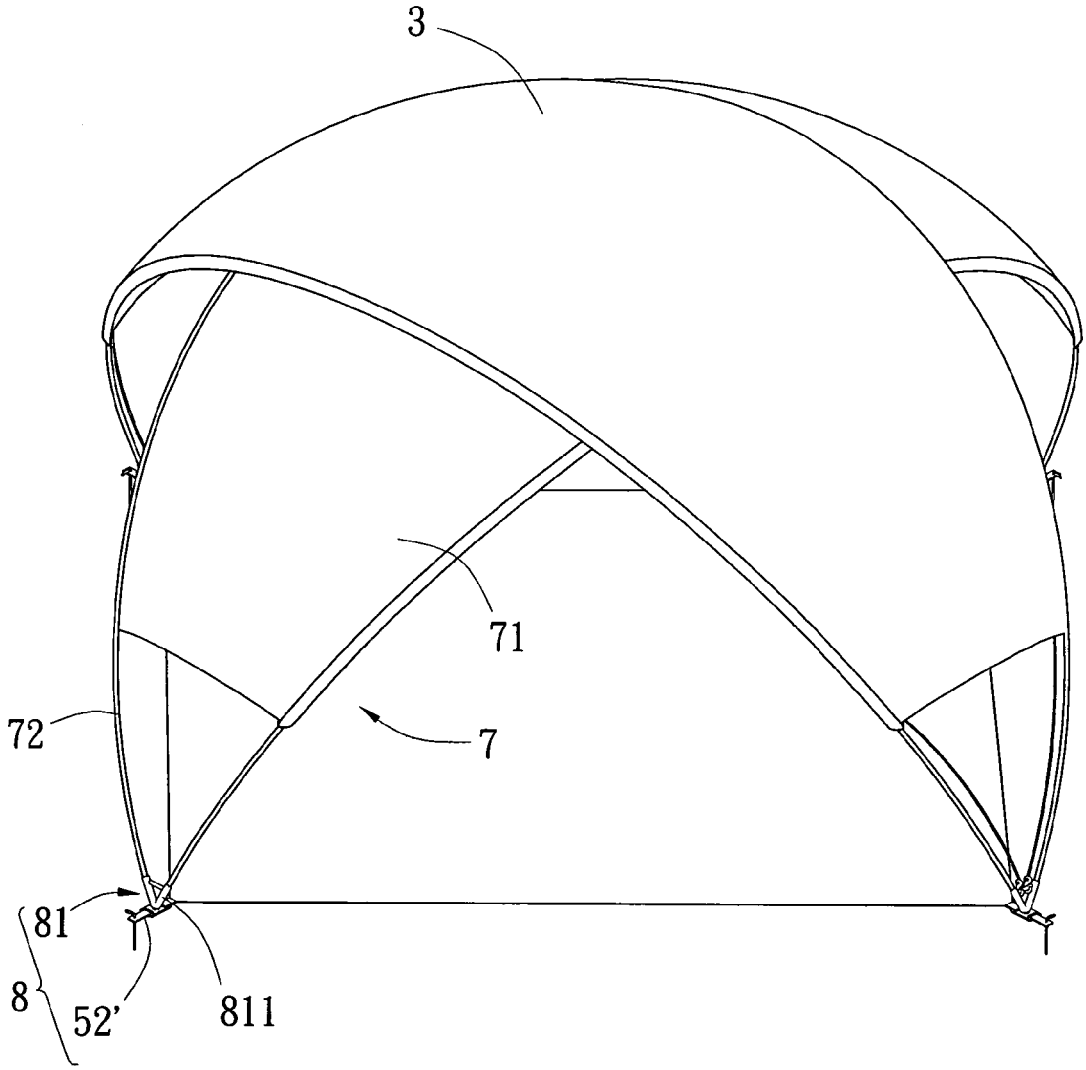
FIG. 6 is a three-dimensional external view of the sunshade tent according to a second embodiment of the invention.
Figure 7:
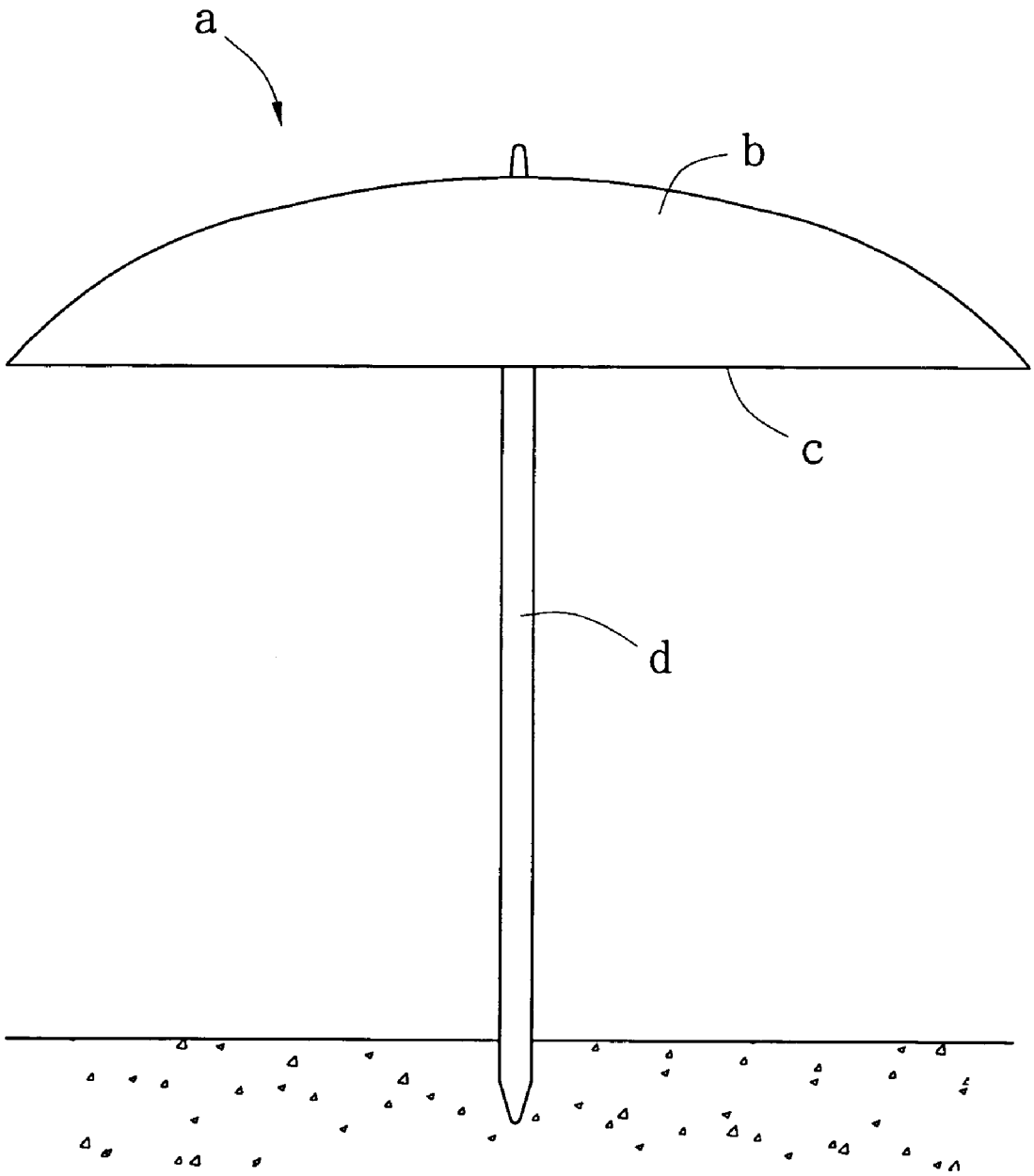
Fig. 7 (Prior Art)
FIG. 7 is a side view of a conventional sunshade umbrella.

Referring to FIG. 6, a sunshade tent 1 according to a second embodiment of the invention is shown, wherein, said supporting 7 comprises a sunshade cloth 71, two sides of said sunshade cloth 71 are combined with a flexible part 72, respectively, while a second adapting module 8 comprises a first adaptor 81 and a connecting part 52' connected to the side corner of a ground cloth 2, wherein the lower end of said first adaptor 81 is engaged with said connecting part 52' and is provided at its upper end with two receiving parts 811 for fixing one end of those two flexible parts 72. By means of the above-described assembly, the above-described sunshade cloth 3 can be fixed at place securely and achieve the effect of sunshade.

Accordingly, the sunshade tent according to the invention has following advantages:

1. The sunshade tent according to the invention is composed of a thin elongated pole, cloths and various small-scale connecting parts, so that it not only can be assembled conveniently, but also is space saving after being taken apart, thereby it is favor in carrying, transportation and storage.
2. During the assembly of the sunshade tent according to the invention, the sunshade cloth and the supporting part are intersected each other, and engage individually to a fixed ground cloth, the whole structure thus produced can be very stable.
3. The sunshade cloth provided according to the invention can slide over the supporting part in a manner that its sheltering direction can be adjusted depending on the incident angle of sunlight.

Accordingly, in view of the foregoing, the sunshade tent provided according to the invention can fulfill the intended objects of the invention, in terms of carrying conveniently, saving storage space, and adjusting the direction of the sunshade cloth in accordance with the incident angle of sunlight. Therefore, the novel sunshade tent according to the invention has an extremely practical value that deserves a patent right.

Many changes and modifications in the above-described embodiment of the invention can, of course, be carried out without departing from the scope thereof.

What is claimed is:

1. A sunshade tent, comprising:

a ground cloth having first and second side corners disposed diagonally with respect to one another and first and second adapting modules provided at said first and second side corners respectively and wherein each of said adapting modules is fixed on the ground with a ground nail, respectively;

a sunshade cloth, and two flexible parts combined with said ground cloth at opposite sides thereof, wherein one end of each of said two flexible parts is connected with respective first and second adapting modules; and a supporting part having two ends disposed diagonally and intersecting said two flexible parts so that said sunshade cloth and said two flexible parts move along said supporting part and means for fixing said sunshade cloth and said two flexible parts at different positions along said supporting part.

2. The sunshade tent as in claim 1, wherein said first adapting module comprises a first adaptor and a first connecting part adapted to be connected to said ground cloth, wherein one end of said first adaptor is connected with said first connecting part, and the other end is provided with two receiving parts for fixing one end of each of the two flexible parts.

3. The sunshade tent as in claim 2, wherein one end of said first adaptor is in a form of inverted A.

4. A sunshade tent, comprising:

a ground cloth having first and second side corners disposed diagonally with respect to one another and first and second adapting modules provided at said first and second side corners respectively and wherein each of said adapting modules is fixed on the ground with a ground nail, respectively;

a sunshade cloth and two flexible parts combined with said ground cloth at opposite sides thereof, wherein one end of each of said two flexible parts is connected with respective first and second adapting modules; and a supporting part having two ends disposed diagonally and intersecting said two flexible parts so that said sunshade cloth and said two flexible parts move along said supporting part and means for fixing said sunshade cloth and said two flexible parts at different positions along said supporting part, wherein, said first adapting module comprises a first adaptor and a first connecting part adapted to be connected to said ground cloth, wherein one end of said first adaptor is adapted to be connected with said first connecting part, and the other end is provided with two receiving parts for fixing one end of each of those two flexible part; and said first adaptor is provided further at its one end with an elastic fastener, while the first connecting part is provided with a through hole penetrating from an upper side through to a lower side thereof, which allows the elastic fastener to penetrate through so as to connect said first adaptor with said first connecting part.

5. The sunshade tent as in claim 1, wherein each of said second adapting modules comprise a second adaptor and a second connecting part, wherein one end of said second adaptor is connected with said second connecting part, while the other end is provided with a bearing part for fixing one end of said supporting part.

6. A sunshade tent, comprising:

a ground cloth having first and second side corners disposed diagonally with respect to one another and first and second adapting modules provided at said first and second side corners respectively and wherein each of said adapting modules is fixed on the ground with a ground nail, respectively;

a sunshade cloth, and two flexible parts combined with said ground cloth at opposite sides thereof, wherein one end of each of said two flexible parts is connected with respective first and second adapting modules; and a supporting part having two ends disposed diagonally and intersecting said two flexible parts so that said sunshade cloth and said two flexible parts move along said supporting part and means for fixing said sunshade cloth and said two flexible parts at different positions along said supporting part, wherein, each of said second adapting medule modules comprises a second adaptor and a second connecting part wherein one end of said second adaptor is connected with said second connecting part, while the other end is provided with a bearing part for fixing one end of said supporting part; and one end of said second adaptor is provided with a fastener, while the second connecting part is provided with a through hole penetrating form an upper side through to a lower side thereof, which allows the fastener to penetrate through so as to connect said second adaptor with said second connecting part.

7. A sunshade tent, comprising:

a ground cloth having first and second side corners disposed diagonally with respect to one another and first and second adapting modules provided at said first and second side corners respectively and wherein each of said adapting modules is fixed on the ground with a ground nail, respectively;

a sunshade cloth and two flexible parts combined with said ground cloth at opposite sides thereof, wherein one end of each of said two flexible parts is connected with respective first and second adapting modules; and a supporting part having two ends disposed diagonally and intersecting said two flexible parts so that said sunshade cloth and said two flexible parts move along said supporting part and means for fixing said sunshade cloth and said two flexible parts at different positions along said supporting part, wherein said tent further comprises at least one fastener, wherein one end of said fastener is connected with said sunshade cloth, and the other end is engaged with said first adaptor so as to stretch said sunshade cloth outwardly.

8. The sunshade tent as in claim 1, wherein said sunshade cloth is provided at its central portion with an accommodating space for allowing said supporting part to penetrate through.

9. The sunshade tent as in claim 1, comprises further a fastener for fixing said sunshade cloth on said supporting part.

10. A sunshade tent, comprising:

a ground cloth having first and second side corners disposed diagonally with respect to one another and first and second adapting modules provided at said first and second side corners respectively and wherein each of said adapting modules is fixed on the ground with a ground nail, respectively;

a sunshade cloth and two flexible parts combined with said around cloth at opposite sides thereof, wherein one end of each of said two flexible parts are connected with respective first and second adapting modules; and a supporting part having two ends disposed diagonally and intersecting said two flexible parts so that said sunshade cloth and said two flexible parts move along said supporting part and means for fixing said sunshade cloth and said two flexible parts at different positions along said supporting part, wherein said supporting part comprises a sunshade cloth, two sides of said sunshade cloth is connected with one flexible part, respectively; while said second adapting module comprises an adaptor and a connecting part adapted to be connected with said ground cloth, and one end of said adaptor is connected with said connecting part, while the other end thereof is provided with two receiving parts for fixing one end of each of those two flexible parts, respectively.

* * * * *